United States Patent [19]

Batts et al.

[11] Patent Number: 4,565,309

[45] Date of Patent: Jan. 21, 1986

[54] SHIPPING HANGER

[75] Inventors: John H. Batts, 2565 Frederick Dr., SE., East Grand Rapids, Mich. 49506; Judd F. Garrison, 3199 E. Beltline, Grand Rapids, Mich. 49505

[73] Assignee: John Thomas Batts, Inc., Zeeland, Mich.

[21] Appl. No.: 619,289

[22] Filed: Jun. 11, 1984

[51] Int. Cl.[4] ..... A47J 51/14

[52] U.S. Cl. ..... 223/96; D6/326

[58] Field of Search ..... 223/96, 93, 91, 95, 223/DIG. 1, 87; D6/315, 326, 327

[56] References Cited

U.S. PATENT DOCUMENTS

| | | | |
|---|---|---|---|
| D. 220,891 | 6/1971 | Charak | D6/327 |
| D. 243,138 | 1/1977 | Loon | D6/326 |
| 1,110,387 | 9/1914 | Gates et al. | 223/96 |
| 2,742,209 | 4/1956 | Reinsch | 223/91 |
| 3,435,999 | 4/1969 | Mantell | 223/91 |
| 3,946,915 | 3/1976 | Crane | 223/96 |

FOREIGN PATENT DOCUMENTS

| | | | |
|---|---|---|---|
| 0095353 | 11/1983 | European Pat. Off. | 223/96 |
| 2055128 | 5/1972 | Fed. Rep. of Germany | 223/96 |
| 2308270 | 8/1974 | Fed. Rep. of Germany | 223/91 |
| 1193061 | 4/1959 | France | 223/91 |

*Primary Examiner*—Robert R. Mackey

*Attorney, Agent, or Firm*—Price, Heneveld, Huizenga & Cooper

[57] ABSTRACT

A garment hanger has upper and lower bars joined at one end by a hinge of a construction which biases the lower jaw into an open position but resists a significant further opening movement even under the weight of a garment draped over it. The two bars are vertically superimposed with the lower bar being longer than the upper bar. A garment clamp is supported on the end of the upper bar distal from the hinge. The clamp has a pair of jaws forming a pocket between them centered over the lower bar. The jaws, when closed, embrace the lower bar and any garment draped over it for holding the garment against displacement from or along the lower bar.

10 Claims, 9 Drawing Figures

SHIPPING HANGER

BACKGROUND OF THE INVENTION

This invention relates to garment hangers which are primarily used to ship clothing from the manufacturer to the retailer. More particularly, this invention relates to garment hangers for garments of the type normally draped over a bar.

Heretofore, garments of the aforementioned type have typically been shipped in one of two ways. Many shippers transport garments such as pants, slacks and the like on hangers with a horizontal bar or rod over which the pants are folded or draped. During shipment, the garments and hangers are jostled from side to side and subject to severe vibration. This causes the garments to slide lengthwise of the bar resulting in some of the garments falling from the bar or gathering at one end of the bar. Garments that fall from or gather at one end of the hanger bar do not arrive in the best condition and frequently must be pressed prior to display. Some shippers have added friction surfaces on the bar so that there is a resistance to the garments sliding lengthwise of the bar. However, the use of high friction surfaces on the bar is not practical because it interferes with the mounting and removal of the garments which must be moved either lengthwise of the bar or across the bar during mounting and removal. In addition, some friction surfaces can snag finely woven material. Bars with friction surfaces also do not completely prevent the garments falling from a gathering on the bars.

Other shippers use a hanger having a horizontal bar equipped with two spaced clamps for gripping the garment. However, such hangers often do not have the resistance to jostling occurring during shipment, which jostling causes the clothing to whip from side to side, often causing the garments to pull out of the clamps permitting them to release from the hanger. This is particularly a problem during transportation which may subject garments to extended periods of vibration, causing the teeth to abrade the fabric. Hangers with paired clamps are difficult to manipulate by hand. Often the user feels he must have three hands, one hand to manipulate each of the clamps and a third to support the garment.

Another factor which has restricted the use of clamping hangers is the problem of obtaining an adequate grip on the garment without creasing or otherwise marking the garment. The use of serrations or teeth of a design sufficient to positively grip the garment is undesirable because of possible damage to the garment during shipment and handling. The problem of providing an adequate grip is further complicated in garments fabricated from tightwoven, smooth surface textiles which have low friction surfaces.

SUMMARY OF THE INVENTION

Garment hangers embodying the present invention include an elongated body and means intermediate the ends of the body for supporting the hanger. The body has upper and lower bars, the upper bar being shorter than the lower bar with the two bars being vertically superimposed. A hinge joins the two bars at one end of the body. A garment clamp is supported on the upper bar at the end thereof distal from the hinge. The clamp has a pair of jaws which embrace the lower bar for clamping a garment draped over the lower bar and positioned between the jaws.

The garment hanger of the present invention is well suited for use as a shipping hanger since the garment draped over the lower bar and embraced thereon by the clamp with the clamp supporting the lower bar cannot slide lengthwise along the bar. Thus, the garment will neither be released from nor gather at one end of the lower bar. Accordingly, a garment suspended from the garment hanger of the present invention can withstand the vibration and jostling that occurs during transport. Furthermore, the garment hanger disclosed is adapted to one hand support and manipulation leaving the other hand free to mount the garment on the hanger. The hanger is also well suited to use for display purposes.

DETAILED DESCRIPTION OF THE PREFERRED EMBODIMENT

Figure 1:
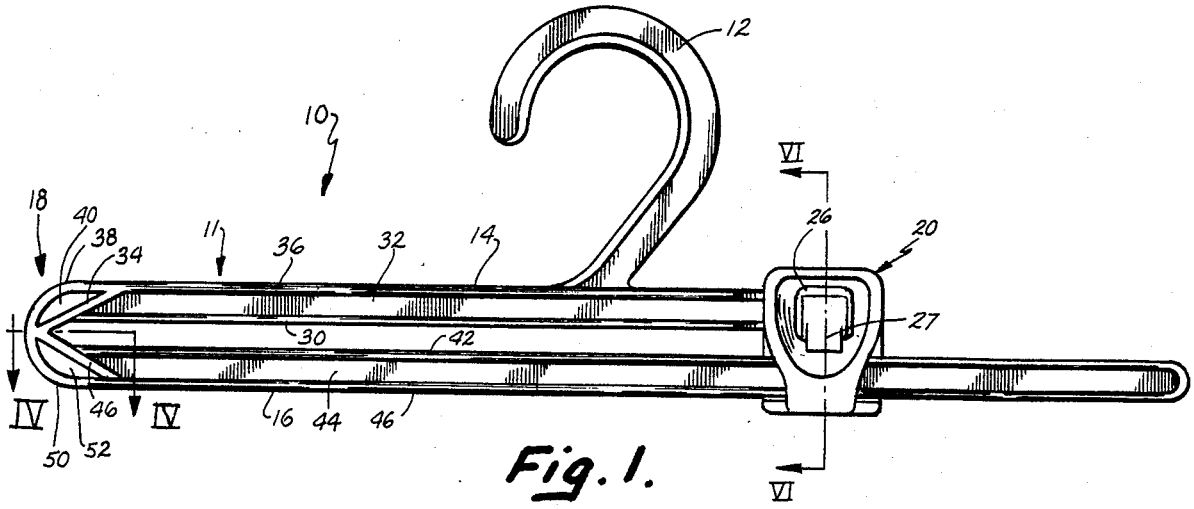
FIG. 1 is a front view of a garment hanger embodying the present invention with the locking clamp in the locked position.
Figure 6:
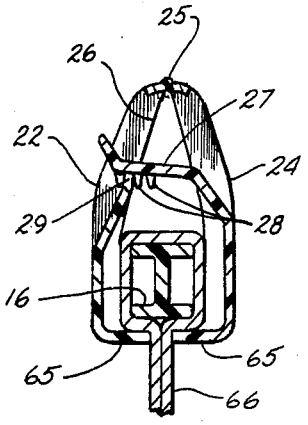
FIG. 6 is a cross section taken along the line VI—VI of FIG. 1.

A garment hanger 10 (FIGS. 1–3) embodying the teachings of the present invention includes an elongate body 11 with means such as hook 12 for supporting the hanger 10. The hook can be molded integrally with the hanger body or can be a separate element such as a conventional wire hook. Further, in the latter construction, the hook can be made such that it can swivel or pivot relative to the body. The body 11 has an upper bar 14 and a lower bar 16 joined together at one end by a hinge 18. A clamp 20 is provided on the upper bar and has a pair of jaws 22, 24 (FIGS. 2, 6 and 7) which can be closed to clamp a garment. When the jaws are closed, the lower bar is enclosed within a pocket between the jaws of the clamp for clamping a garment 66 (FIG. 6) draped over the lower bar and positioned between the jaws (FIG. 6).

Figure 3:
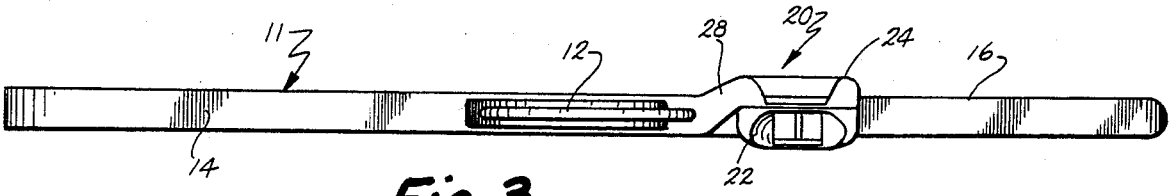
FIG. 3 is a top view of the garment hanger of the present invention with the locking clamp shown in the locked position.

As shown in FIG. 3, the upper bar 14 and the lower bar 16 which comprise body 11 are vertically superimposed. This allows the hanger to lie on a vertical plane when suspended from hook 12 with a garment draped over the lower bar. This is important when the hanger is used for transport since it permits close packing under conditions in which space is at a premium.

To permit clamping of the lower bar between jaws 22, 24, the upper bar is provided with an offset portion 28 adjacent the clamp for centering the pocket within the clamp directly over the longitudinal axis of lower bar 16.

Lower bar 16 is longer than the maximum width of the garment to be hung on hanger 10. Therefore, no portion of the garment will extend beyond the free end of lower bar 16 when one end of the garment is positioned as close as possible to the hinge 18 without the necessity of gathering of the garment adjacent the hinge 18.

Preferably, the upper bar 14 is shorter than lower bar 16. This facilitates mounting the garment on the lower bar. The portion of the lower bar which extends beyond clamp 20 serves as a guide for introducing and sliding the garment onto the lower bar when the clamp is open. This permits the lead end of the garment to be closely seated about the bar when it reaches the clamp, and it will slide between and beneath the jaws of the clamp without becoming entangled with them. This arrangement leaves a substantial portion of the free end of the lower bar accessible and free of obstruction above it.

Each of the upper and lower bars 14, 16 has the cross-sectional shape of an I-beam (FIGS. 6 and 7) to give its strength and rigidity with relatively low material requirements. Bar 14 has upper and lower horizontal flanges 36 and 30 joined by a vertical intermediate web 32. Bar 16 has upper and lower horizontal flanges 42 and 46 joined by a vertical web 44.

Figure 2:
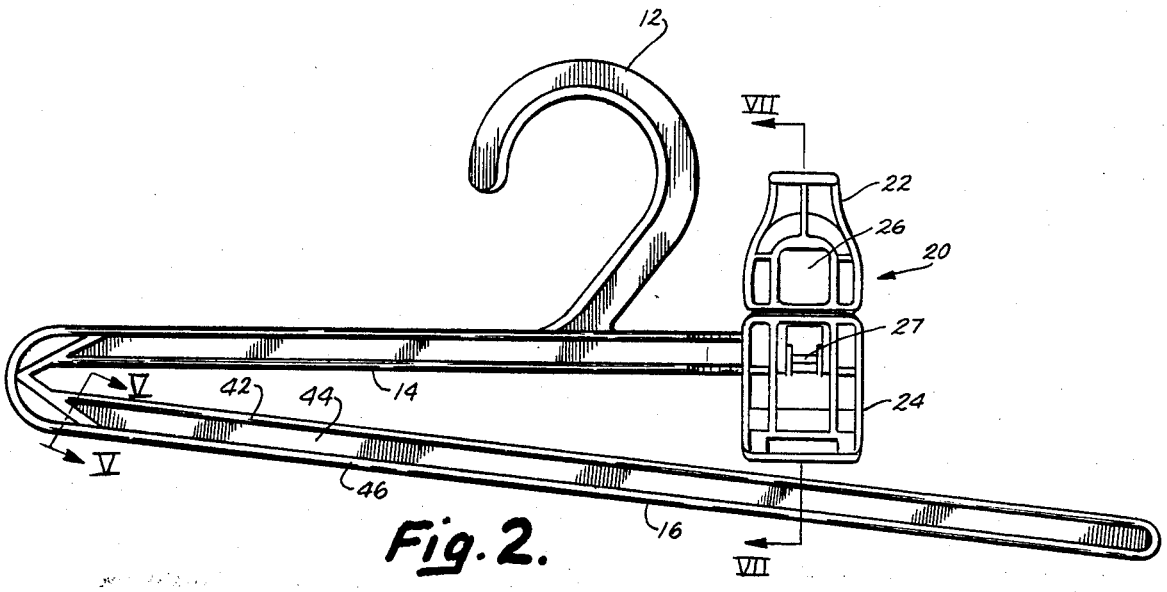
FIG. 2 is a front view of the garment hanger embodying the present invention with the locking clamp shown in the fully open position as the hanger is molded.

The angular position of the bars, as molded, is illustrated in FIG. 2. Hinge 18 joins upper bar 14 and lower bar 16 at the end of the hanger distal from clamp 20. Hinge 18 is designed to limit the downward pivotal movement of the lower bar 16 under the weight of the garment as it is being draped over the lower bar or when the clamp is opened to remove the garment. This also permits the user to hold the hanger by the hook or by the upper bar, and the lower bar will not pivot to a position where it would be awkward to drape the garment over the lower bar. This feature allows the user to slide the garment onto the lower bar, and while the garment is supported by the lower bar, manipulate the clamp to lock it into clamping position around the garment and the lower bar. Thus, there is no need for "three hands".

The novel construction of hinge 18 limits the downward pivotal movement of the lower bar. In fact, it substantially prevents increasing the angular relationship of the bars. Hinge 18 includes a pair of substantially rigid struts 34, 46, each of fixed length arranged in a V with respect to each other, and a pair of curved spring members 38, 50 which form a U-shaped spring element extending from the top of the upper bar to the bottom of the lower bar. The apex of the V formed by the struts is integrally formed with the U-shaped spring element and divides the spring element into an upper spring member 38 and a lower spring member 50. The other ends of the struts are integral with the top and bottom of the upper and lower bars, respectively. The lower horizontal flange 30 and vertical intermediate web 32 of upper bar 14 terminate in and are integral with the strut 34. Web 32 and flange 30, because they are integrally formed with strut 34, form a T-shaped reinforcement which imparts structural rigidity to strut 34 and prevents strut 34 from bending along much of its longitudinal length. The only portion of strut 34 which can bend even slightly is the short portion which extends below and beyond flange 30. Strut 46 is also reinforced with web 44 and upper flange 42 of the lower bar 16 terminating in and being integral with the strut 46 which imparts rigidity to strut 46.

Spring member 38 is integral with the opposite ends of strut 34 and is arched away from it creating an opening 40 between strut 34 and spring member 38. Spring member 50 is integrally joined to both ends of strut 46 and is arched away from it creating an opening 52 between strut 46 and spring member 50. The struts form chords of substantially fixed length having very little flexibility thus forcing the spring members 38 and 50 into compression when it is attempted to pivot the lower bar away from the upper bar.

Hinge 18, due to its novel construction, not only resists very angular displacement of the lower bar 16, it also, when only minor downward angular movement has occurred, in effect, locks up. Thus, the lower bar, even without support from the clamp, will readily support even relatively heavy garments without excessive angular displacement. In this regard, it is important that the hanger is molded with the lower bar in the open position illustrated in FIG. 2. In this position, it is clear of the clamp 20 for mounting a garment on it. Because of the construction of the hinge 18, as previously explained, further downward or opening movement is substantially eliminated. Thus, the hanger does not have to be manipulated by the user to prepare it to receive a garment. This is a feature of considerable convenience to the user. This permits the user to support the hanger without the lower bar pivoting to a position where it would be difficult to introduce the free end of the lower bar into the folded portion of the garment. In fact, by tilting the hanger slightly upwardly, the lower bar can be positioned horizontally to facilitate sliding a garment onto it without the garment having a tendency to slide back off it. Accordingly, the hanger of the present invention is very easy to use.

Figure 7:
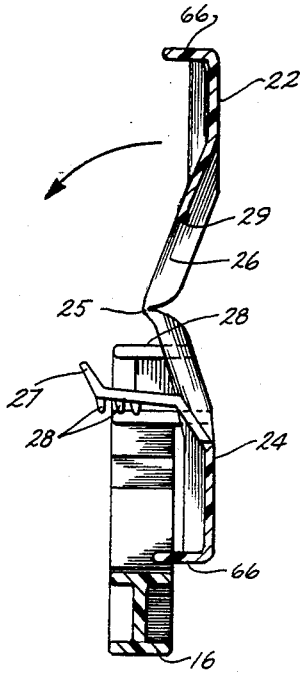
FIG. 7 is a cross section taken along the line VII—VII of FIG. 2.

Clamp 20 is illustrated in FIGS. 1, 2, 6 and 7. As shown in FIGS. 6 and 7, clamp 20 has a pair of jaws 22 and 24 joined by a thin, flexible web or living hinge 25. Jaw 22 is provided with an aperture 26 therethrough which is close to the central portion of clamp 20 (FIG. 2). Jaw 24 includes a latch 27 integrally molded therewith which extends inwardly of the clamp. Latch 27 preferably has one or more teeth 28 to engage and lock with the lower edge 29 of aperture 26, which edge serves as a keeper to accommodate garments of varying thicknesses.

As can be seen in FIG. 6, jaws 22 and 24 arch away from each-other in the closed position so as to create a space or chamber between the jaws sufficient to embrace the lower bar and a garment 66 draped over it. The ends of each of the jaws 22, 24 distal from hinge 25 are provided with two flanges 65 which project inwardly of the clamp when the clamp is in the locked position. Flanges 65 are urged toward each other when clamp 20 is closed, thereby supporting the lower bar 16 and clamping a garment 66 around it. The flanges are of a length to permit the jaws to close without actually seating against the sides of the lower bar. This arrangement insures wrapping of the garment about the lower bar without the garment restricting closing movement by engaging the sides of the pocket and preventing the jaws from gently wrapping the garment about the lower bar.

It should be noted, as shown in FIG. 6, that the garment is not clamped tightly between flanges 65 or pressed tightly around the bar 16 when the bar and the garment are clamped between the jaws. Instead, the lower bar is spaced from flanges 65 when the clamp is closed. This feature reduces the wrinkling which might otherwise occur if the flanges 65 were not spaced below the lower bar and held the garment closely against the bottom of the lower bar.

Figure 9:
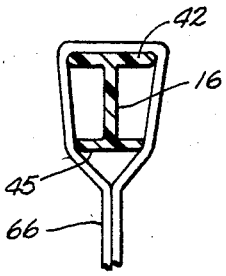
FIG. 9 is a cross-sectional view through a modified lower bar of the hanger of the present invention with a garment draped over the bar.

In fact, as shown in FIG. 9, the lower flange 45 of lower bar 16 can be narrower than the upper flange 42 such that the clamp will not impart any sharp folds in that portion of the garment fabric embraced within the jaws of the clamp. Of course, the lower flange 45 in such a modified hanger would widen in the region near hinge 18 to provide the necessary reinforcement and pivot resistance in that area.

Clamp 20 is designed such that jaw 24 is fixed while jaw 22 is pivotal relative thereto. In the embodiment shown in FIG. 7, this permits jaw 24 to be integrally molded with upper bar 14 with jaw 22 being molded in fully open position aligned in the same plane as jaw 24 as illustrated in FIGS. 2 and 7. Thus, the entire hanger can be molded as a single unit in a relatively simple mold.

The clamp shown in FIGS. 1–3 and 6 and 7 is a modified version of the clamp disclosed in U.S. Pat. No. 3,698,043 entitled Molded Garment Clamp, the disclosure of which is incorporated by reference herein. However, as shown in FIG. 8, other types of clamps may be used as well.

Figure 8:
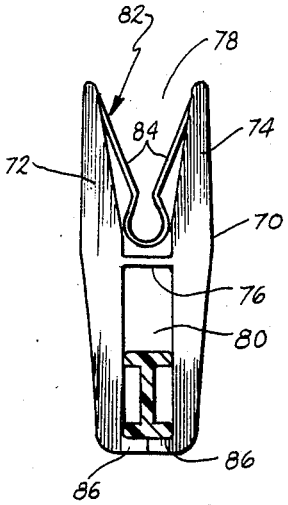
FIG. 8 is an end view of an alternative clamp which can be used with the hanger of the present invention.
Figure 4:
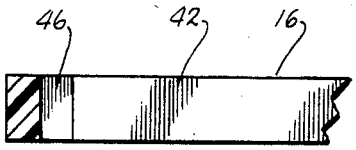
FIG. 4 is a cross section taken along the line IV—IV of FIG. 1.
Figure 5:
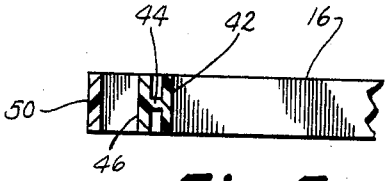
FIG. 5 is a cross section taken along the line V—V of FIG. 2.

The clamp of FIG. 8 is a modified version of the clamp disclosed in U.S. Pat. No. 4,395,799 entitled Spring Biased Plastic Article Clamp, the disclosure of which is incorporated herein by reference. The clamp 70 of FIG. 8 has a pair of elongated arms 72, 74 joined intermediate their ends by a flexible hinge or web 76 integrally formed with the two arms. The web divides the clamp into an upper handle pocket 78 and a lower article clamping pocket 80. A generally V-shaped spring 82 is seated in pocket 78. The ends 84 of the spring flare outwardly and are secured to the tops of arms 72, 74, respectively. The ends of the spring at the time of installation are initially pressed together to load the spring and provide a closing bias to the clamp 70.

The ends of arms 72, 74 distal from spring 82 are provided with inwardly projecting flanges 86 which meet when the clamp is closed about the lower bar. The arm 74 may be integral adjacent the web 76 with the upper bar of the hanger. The upper bar, to accommodate the clamp of the embodiment of FIG. 8, will be provided with an offset portion (not shown) similar to that illustrated in FIG. 3 to vertically center clamp 70 over lower bar 16. Such an arrangement will require a more complicated mold because it will require laterally movable cams to mold the clamp. Another approach would be to mold the clamp separately with suitable means such as a bayonet interlock to secure it to the upper bar.

A variety of synthetic resins can be used to manufacture the various embodiments of the hanger disclosed above. Polypropylene, polyethylene and nylon are resins particularly suitable for this application. The material must be sufficiently fatigue resistant to insure that hinge 25 and web 76 can withstand repeated flexing without failure and must be sufficiently resistant to flexing that arms 22 and 24 of clamp 20 will deflect only slightly when clamped to insure adequate clamping pressure when the clamp is closed. Spring 82 is preferably made from spring steel. With the exception of spring 82, the hanger of either embodiment can be integrally molded using conventional injection molding technology. Thus, the hangers of the present invention are inexpensive to manufacture.

Having described preferred embodiments of the invention, it will be recognized by those skilled in the art that modifications can be made without departing from the principles of the invention. Such modifications are to be considered as included in the appended claims unless these claims, by their language, expressly state otherwise.

We claim:

1. A garment hanger having an elongate body and means intermediate the ends of the body for supporting the hanger, said body having an upper bar and a lower bar, said bars being vertically superimposed, an integral hinge joining said bars at one end of the body, the hanger characterized in that the upper bar is substantially shorter than the lower bar and has front and rear faces, and a garment clamp is supported on the end of said upper bar intermediate the ends of the lower bar, said clamp having a pair of jaws embracing said lower bar for clamping a garment draped over said lower bar and between said jaws, one of said jaws being stationary and the other pivotal, said clamp being offset rearwardly with respect to said lower bar whereby said fixed jaw is vertical and extends below and generally parallel to said rear face of said lower bar.

2. The garment hanger recited in claim 1 further comprising a latch for locking said jaws together in clamped position.

3. The garment hanger as recited in claim 1 wherein said clamp, said upper and lower bars and said hinge are molded as a single unitary element.

4. The garment hanger as recited in claim 3 which further comprises each jaw having a flange integrally formed with said jaw, projecting inwardly of said clamp and extending beneath said lower bar as said clamp is closed to support said lower bar and to partially wrap a garment draped over said lower bar beneath said bar and cause the garment to positively, frictionally engage said bar.

5. A garment hanger having an elongate body and means intermediate the ends of the body for supporting the hanger, said body having an upper bar and a lower bar, said bars being vertically superimposed, an integral hinge joining said bars at one end of the body, the hanger characterized in that the upper bar is shorter than the lower bar, and a garment clamp is supported on said upper bar intermediate the ends of the lower bar, said clamp having a pair of jaws embracing said lower bar for clamping a garment draped over said lower bar and between said jaws; said hinge having a U-shaped spring element extending from the top of said upper bar to the bottom of said lower bar and being detached from both bars between its ends, a pair of substantially rigid struts of fixed length arranged in a V with its apex integral with said spring element substantially midway between said bars and dividing said spring element into upper and lower operative segments; the other ends of said struts being integral with the top and bottom of said upper and lower bars, respectively, whereby pivotal movement of said lower bar requires each of said spring element segments to be compressed and to deflect outwardly.

6. The garment hanger described in claim 5 wherein said upper and lower bars are I-beam shaped, each bar having horizontal flanges joined by a vertical web, said flanges of said upper and lower bars being at the top and the bottom of said bars, respectively, said spring element being integral and an extension of the upper flange of the upper bar and the lower flange of the lower bar.

7. The garment hanger described in claim 6 wherein the vertical legs of said upper and lower flanges are integral with and stiffen the respective adjacent ones of said struts.

8. The garment hanger described in claim 5 wherein said upper and lower bars are of I-beam cross section having horizontal flanges joined by a vertical web, the vertical webs and adjacent flanges of said bars being integral with and stiffening the respective adjacent ones of said struts.

9. A garment hanger having upper and lower superimposed bars and means intermediate the ends of the hanger for supporting the hanger, an integral hinge joining said bars at one end of the hanger, said hinge having means resistant to pivotal movement for supporting said lower bar normally in a downwardly inclined position at a small angle with respect to said upper bar and capable of generating progressively increasing resistance to downward pivotal movement thereof, said means including a U-shaped resilient element connecting the top of the upper bar with the bottom of the lower bar and a rigid V-shaped stiffener having a pair of arms of fixed length, the apex of the stiffener being connected to the element midway between the ends of the element and the ends of the arms being connected to the ends of the legs of the element, the upper bar being substantially shorter than the lower bar, a garment clamp supported on the end of said upper bar, spaced from the free end of the lower bar and having a pair of jaws defining a pocket therebetween for receiving said lower bar therein when the jaws are closed.

10. A garment hanger having upper and lower superimposed bars and means intermediate the ends of the hanger for supporting the hanger, an integral hinge joining said bars at one end of the hanger, the upper bar being shorter than the lower bar, a garment clamp supported on said upper bar intermediate the ends of the lower bar and having a pair of jaws defining a pocket therebetween for receiving said lower bar when the jaws are closed; said hanger being molded as a single piece wherein said lower bar is inclined away from said upper bar at a minor angle, said hinge having means restraining any substantial increase in the angular relationship between said bars while permitting the lower bar to be moved to a position parallel to said upper bar; said hinge being U-shaped, and said restraining means including rigid strut elements integral with said hinge midpoint between said upper and lower bars for holding said midpoint of the hinge against movement in any direction and restricting movement of the segments of said hinge on both sides of said midpoint.

* * * * *